United States Patent [19]

Koisuka et al.

[11] Patent Number: 4,587,701

[45] Date of Patent: May 13, 1986

[54] METHOD FOR PRODUCING AN ALUMINUM HEAT EXCHANGER

[75] Inventors: Mikio Koisuka; Hisao Aoki, both of Gunma, Japan

[73] Assignee: Sanden Corporation, Gunma, Japan

[21] Appl. No.: 644,815

[22] Filed: Aug. 27, 1984

[30] Foreign Application Priority Data

Aug. 25, 1983 [JP] Japan ..... 58-130338

[51] Int. Cl.[4] ..... B21D 53/06

[52] U.S. Cl. ..... 29/157.3 A; 29/157.3 R; 228/183; 228/255

[58] Field of Search ..... 29/157.3 A, 157.3 R, 29/157.3 AH; 228/183, 255; 165/152, 183; 62/285, 515

[56] References Cited

U.S. PATENT DOCUMENTS

| | | | |
|---|---|---|---|
| 2,838,830 | 6/1958 | Huggins . | |
| 3,521,707 | 7/1970 | Brown . | |
| 4,214,925 | 7/1980 | Arita et al. . | |
| 4,327,800 | 5/1982 | Miller | 228/183 X |

FOREIGN PATENT DOCUMENTS

| | | | |
|---|---|---|---|
| 2178784 | 11/1973 | France | 24/157.3 R |
| 16722 | 2/1980 | Japan | 228/255 |
| 22870 | 2/1982 | Japan | 228/183 |
| 97820 | 6/1982 | Japan | 29/157.3 R |
| 1055572 | 11/1983 | U.S.S.R. | 29/157.3 D |

*Primary Examiner*—Howard N. Goldberg
*Assistant Examiner*—Carl J. Arbes
*Attorney, Agent, or Firm*—Hopgood, Calimafde, Kalil, Blaustein & Judlowe

[57] ABSTRACT

A serpentine-type aluminum heat exchanger comprising a serpentine-anfractuous flat tube of an aluminum alloy, a plurality of corrugated fin units made of an aluminum alloy having a high aluminum content of 99 wt. % or more, and brazing metal coating layers fixed onto entire flat surfaces of parallel portions of the serpentine-anfractuous flat tube and for joining the flat tube and the fin units, is produced by preparing the serpentine-anfractuous flat tube of an aluminum alloy, the corrugated fin units and U-shaped members of an aluminum alloy brazing filler metal, closely fitting the U-shaped members onto the parallel portions of the flat tube, disposing the fin units in spaces between adjacent U-shaped members fitted onto the parallel portions of the flat tube, and heating the flat tube, the fin units and U-shaped members in the assembled relation to the brazing temperature.

7 Claims, 5 Drawing Figures

METHOD FOR PRODUCING AN ALUMINUM HEAT EXCHANGER

BACKGROUND OF THE INVENTION (1) Field of the Invention

The present invention relates to aluminum heat exchangers, and in particular, to a method for providing the heat exchanger of a serpentine type.

(2) Description of the Prior Art

Heat exchangers of the serpentine type have been used for, for example, a refrigerant evaporator in an automotive air conditioning system, as shown in, for example, U.S. Pat. Nos. 4,350,025, and 4,353,224.

The serpentine-type heat exchanger comprises a flat metal tube having a refrigerant passageway or parallel passageways therein extending in a longitudinal direction of the tube. The flat tube is bent to weave up and down, or formed in a serpentine-anfractuous shape, and therefore, has a plurality of parallel portions spaced apart from one another and a plurality of U-shaped curved portions connecting adjacent ones of the parallel portions, respectively. A plurality of corrugated fin units are disposed in spaces between adjacent ones of the parallel portion of the tube and are joined thereto by brazing. Each of the corrugated fin units is formed by bending a thin plate in a corrugated form so that a number of crests are formed in opposite side surfaces of the unit alternatively. The crests in the opposite sides of the unit are joined by brazing to flat side surfaces of the opposite parallel portions of the tube.

As high heat-conductivity materials for the flat tube and the fin units, aluminum metals including aluminum and aluminum alloy are usually used. Such heat exchangers using aluminum metals are referred to as aluminum heat exchanger.

In a known serpentine-type aluminum heat exchanger, the serpentine-anfractuous flat tube is usually made of an aluminum metal having 99 wt. % or more Al, for example, AA 1050 (which comprises, by weight, 0.25% or less Si, 0.40% or less Fe, 0.05% or less Cu, 0.05% or less Mn, 0.05% or less Mg, 0.05% or less Zn, 0.03% or less Ti and 99.50% or more Al). While, an aluminum alloy brazing sheet is used for preparing the corrugated fin unit member, which has a core metal of AA 3003 (which comprises, by weight, 0.6% or less Si, 0.7% or less Fe, 0.05–0.20% Cu, 1.0–1.5% Mn, 0.10% or less Zn and the balance Al) with a cladding of an aluminum alloy brazing filler metal, such as AA 4343, 4045 or 4047 (which comprises, by weight, 0.30% or less Cu, 5–13% Si, 0.8% or less Fe, 0.15% or less Mn, up to 0.1% Mg, 0.20% or less Zn, up to 0.20% Ti, and the balance substantially Al). The brazing sheet is formed in a form of the corrugated fin unit, and the fin unit members thus formed are disposed in spaces between adjacent ones of parallel portions of the flat tube so that the crests in the opposite sides of each fin unit member are in contact with the opposite parallel portions of the flat tube. Then, the flat tube and fin unit members are heated in the assembled relation to a brazing temperature of about 600° C., and are joined by brazing.

In the known serpentine-type aluminum heat exchanger, the flat tube tends to suffer from pittings by corrosion because the aluminum alloy AA 1050 of the flat tube is baser in the corrosion potential than the aluminum alloy AA 3003 of the fin unit material. However, use of another aluminum metal having a corrosion potential equal to, or baser than, that of the flat tube for the core metal of the brazing sheet results in deformation of the fin units during the brazing operation, because elements of the aluminum alloy brazing filler metal diffuse into the core alloy during the brazing operation to lower the melting point of the core metal. Further, the core metal becomes nobler than the flat tube as another result of the diffusion, so that the flat tube still tends to suffer from the pittings.

Moreover, the use of the brazing sheet results in high cost of the heat exchanger.

Furthermore, in the known serpentine-type aluminum heat exchanger, the fin unit has a coating of the aluminum alloy brazing metal layer which is lower in the heat conductivity than the core metal and the flat tube. This means that the aluminum alloy brazing metal layer on the fin unit degrades the heat exchanging property of the exchanger.

In order to dissolve such problems, a novel serpentine-type aluminum heat exchanger and a method for producing the same are proposed in a copending U.S. application Ser. No. 644,816 filed Aug. 27, 1984 in the name of Hisa Aoki which application is assigned to the same assignee.

The novel serpentine-type aluminum heat exchanger comprises a serpentine-anfractuous flat tube of an aluminum alloy and a plurality of corrugated fin units made of an aluminum alloy having a high aluminum content of 99 wt. % of more and joined to the flat tube by brazing metal coating layers fixed onto flat surfaces of parallel portions of the serpentine-anfractuous flat tube.

The novel exchanger is produced by preparing the serpentine-anfractuous flat tube of an aluminum alloy, the corrugated fin units and foil plates of an aluminum alloy brazing filler metal, disposing the fin units in spaces between adjacent ones of parallel portions of the serpentine-anfractuous flat tube with foil plates being interposed between respective fin units and opposite parallel portions of the flat tube, and heating the flat tube, the fin units, and the foil plates in the assembled relation to the brazing temperature.

In the novel aluminum heat exchanger, the flat tube is protected from pittings due to the difference between the corrosion potentials of the flat tube and the fin units, because the flat tube is substantially nobler in the corrosion potential than that of the fin units and because the surface of the flat tube is coated with the aluminum brazing metal layer. Further, since the aluminum metal of the fin unit is excellent in the heat conductivity, the heat exchanging property is improved in comparison with the known aluminum heat exchanger.

However, in the method proposed in the aforementioned copending U.S. patent application Ser. No. 644,816, foil plates of aluminum alloy brazing filler metal are merely interposed between each fin unit and the opposite parallel portions of flat tube. Therefore, it is difficult to maintain foil plates stable in their proper places during a period from the assembling process to the brazing process, that is, the foil plates may fall out from the proper place. Accordingly, the proposed method has a problem.

SUMMARY OF THE INVENTION

It is an object of the present invention to provide an improved method for producing a serpentine-type aluminum heat exchanger which is excellent in heat exchanging property and in corrosion resistance of the flat tube.

It is another object of the present invention to provide an easy method for producing the heat exchanger.

The present invention relates to a method for producing an aluminum heat exchanger comprising a flat aluminum tube which is provided with at least one refrigerant passageway therein and formed in a serpentine-anfractuous shape in a longitudinal direction of the tube to have a plurality of parallel portions spaced apart from one another, and a plurality of aluminum metal fin units each having a corrugated configuration and being interposed between, and brazed to, adjacent ones of the parallel portions walls of the flat tube. The method of the present invention is characterized by preparing the serpentine-anfractuous flat aluminum metal tube, the corrugated aluminum metal fin units of a first aluminum metal having a high aluminum content of 99 wt. % or more, and a plurality of U-shaped members of an aluminum alloy filler metal, closely fitting the U-shaped members onto the respective parallel portions of the flat tube, disposing the corrugated fin units in spaces between the opposite U-shaped portions fitted on the parallel portions of the flat tube, and heating the flat tube, the fin units, and the U-shaped members in the assembled relation to a brazing temperature for joining the fin units and the flat tube and for providing a coating layer of the brazing metal on an entire surface of each parallel portion of the flat tube.

Preferably, AA 1050 aluminum alloy may be used for the aluminum metal of the fin unit, which comprises, by weight, 0.25% or less Si, 0.40% or less Fe, 0.05% or less Cu, 0.05% or less Mn, 0.05% or less Mg, 0.05% or less Zn, 0.03% or less Ti and 99.50% or more Al.

The flat tube may be preferably made of a second aluminum metal having a corrosion potential which is substantially equal to, or nobler than, that of the first aluminum alloy of the fin units. As the second aluminum metal, the above-described AA 1050, or AA 3003 which comprises, by weight, 0.6% or less Si, 0.7% or less Fe, 0.05–0.20% Cu, 1.0–1.5% Mn, 0.10% or less Zn and the balance Al, may be used.

An aluminum alloy brazing filler metal, such as AA 4343, 4045, or 4047, which comprises, by weight, 0.3% or less Cu, 5–13% Si, 0.8% or less Fe, 0.15% or less Mn, up to 0.1% Mg, 0.2% or less Zn, and the balance substantially Al, may be used for the aluminum brazing metal layer.

According to the method of the present invention, since the aluminum alloy brazing filler metal elements are in a form of a U-shaped member and are closely fitted onto respective parallel portions walls of the flat tube, they are easily attached onto the flat tube and are maintained stable during a period from the assembling process to the brazing process. Accordingly, the production of the heat exchanger is readily made.

The heat exchanger produced by the method of the present invention is excellent in the heat exchanging property and the corrosion resistance of the flat tube similar to the heat exchanger proposed in the above-described copending U.S. patent application Ser. No. 644,816.

Further objects, features and other aspects of the present invention will be understood from the following detailed description referring to the accompanying drawings.

DETAILED DESCRIPTION OF THE PREFERRED EMBODIMENTS

Figure 1:
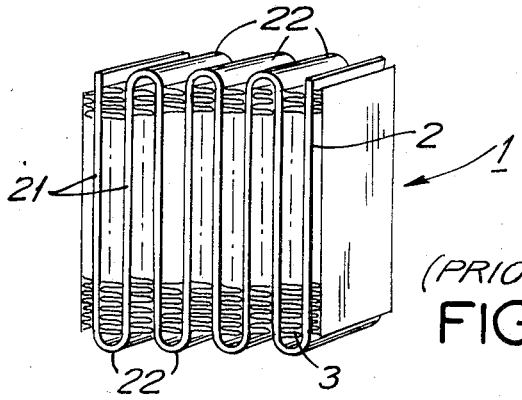
(PRIOR ART) FIG. 1
FIG. 1 is a perspective view of a typical serpentine-type heat exchanger.

Referring to FIG. 1, a typical serpentine-type heat exchanger 1 comprises a flat metal tube 2. Flat metal tube 2 is provided with a refrigerant passageway or parallel passageways therein extending in a longitudinal direction of the tube, and is bent to weave up and down, or formed in a serpentine-anfractuous shape. Therefore, the flat tube 2 has a plurality of parallel portions 21 spaced apart from one another and a plurality of U-shaped curved portions 22 connecting adjacent ones of parallel portions 21, respectively. A plurality of corrugated fin units 3 are disposed in the spaces between adjacent ones of the parallel portions 21 of flat tube 2 and are joined thereto by brazing.

Figure 2:
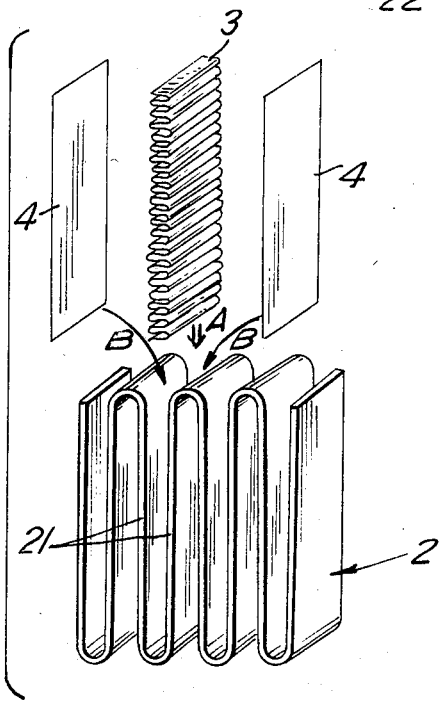
FIG. 2 is a perspective view for illustrating an assembling process in the proposed method in the copending U.S. patent application Ser. No. 644,816.

Referring to FIG. 2, a serpentine-anfractuous flat tube 2 of an aluminum alloy is prepared similar to the flat tube in a known heat exchanger. While, corrugated fin units 3 are prepared from plates of an aluminum alloy having a high aluminum content of 99 wt. % or more, without any brazing filler metals. Therefore, the aluminum alloy is exposed on the fin surface. Foil plates 4 are also prepared from an aluminum alloy brazing filler metal which has a melting point of about 600° C., lower than that of either one of flat tube 2 and fin unit 3 and is adaptable for brazing flat tube 2 and fin units 3.

Each fin unit 3 is disposed in a spaced between adjacent ones of parallel portions 21 of flat tube 2, with foil plates 4 being interposed between fin unit 3 and opposite parallel portions 21 of flat tube 2, as indicated by arrows A and B in FIG. 2.

Flat tube 2, fin units 3 and foil plates 4 are heated in the assembled relation to a brazing temperature above the melting point of the foil plates 4 for joining fin units 3 and flat tube 2.

Figure 3:
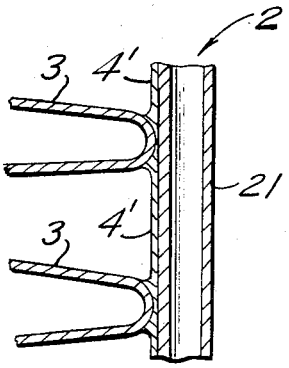
FIG. 3 is a cross sectional view of a main portion of the heat exchanger proposed in the copending U.S. patent application Ser. No. 644,816.

After cooling, fin units 3 and flat tube 2 are joined to one another through the brazing metal layer 4', as shown in FIG. 3.

Since a foil plate 4 of aluminum alloy brazing filler metal is used between each fin unit 3 and an opposite flat surface of parallel portion 21 of flat tube 2, the flat surface of each parallel portion 21 of flat tube 2 is entirely coated with the brazing metal layer 4'. Therefore, flat tube 2 is protected by the coating layers 4' from pittings due to the difference between corrosion potentials of the fin material and the flat tube material.

According to the above-described method illustrated in FIG. 2, since no brazing sheet is used for fin units, costs of the heat exchanger is lowered, as well as an aluminum alloy having a high aluminum content such as 99 wt. % or more Al, which has a high heat conductivity, is also used for fin units 3 so that the heat exchanging property can be improved.

In the method proposed in the copending U.S. patent application Ser. No. 644,816, it is difficult to maintain foil plates 4 stable in proper places during a period from the assembling process to the brazing process, as described hereinbefore.

The present invention provides a method wherein the aluminum alloy brazing filler metal elements can be maintained stable in proper places.

Figure 4:
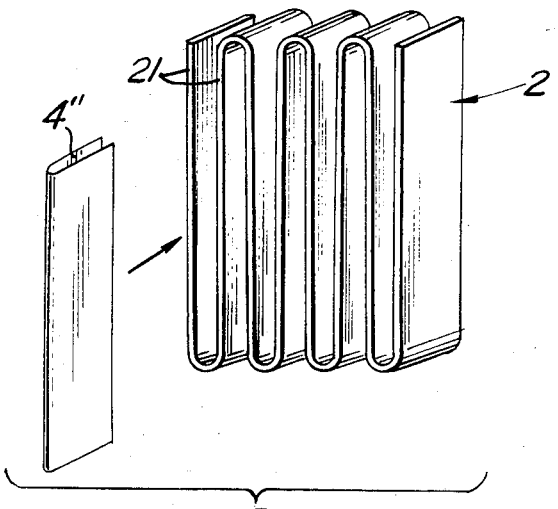
FIGS. 4 and 5 are perspective views for illustrating assembling processes of parts in the method of the present invention.
Figure 5:
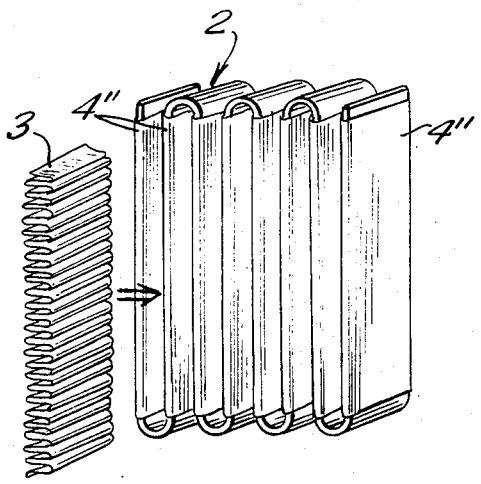

Referring to FIGS. 4 and 5, the aluminum alloy brazing filler metal elements are prepared as U-shaped members 4''. U-shaped members 4'' are closely fitted onto respective parallel portions 21 of flat tube 2, as shown in FIG. 4. Thus, U-shaped members 4'' are stably attached onto flat tube 2 and do not automatically remove from flat tube.

Then, corrugated fin units 3 are disposed in spaces between U-shaped members 4'' on opposite parallel portions 21 of flat tube 2, as shown in FIG. 5.

Thereafter, flat tube 2, fin units 3 and U-shaped members 4'' are heated in the assembled relation to a brazing temperature above the melting point of U-shaped members 4'' for joining fin units 3 and flat tube 2.

After cooling, fin units 3 and flat tube 2 are joined to one another through the brazing metal layer 4', and the flat surface of each parallel portion 21 of flat tube 2 is entirely coated with the brazing metal layer 4', as shown in FIG. 3.

In the aluminum heat exchanger according to the present invention, an aluminum alloy having a high aluminum content of 99 wt. % or more, is used for corrugated fin unit 3, and serpentine-anfractuous flat tube 2 is made of an aluminum alloy having a corrosion potential substantially equal to, or nobler than, that of the fin material. An aluminum alloy brazing filler metal such as AA 4343 (which comprises, by weight, 0.25% or less Cu, 6.8–8.2% Si, 0.8% or less Fe, 0.10% or less Mn, 0.20% or less Zn, and the balance substantially Al), 4045 (which comprises, by weight, 0.30% or less Cu, 9.0–11.0% Si, 0.8% or less Fe, 0.05% or less Mn, 0.05% or less Mg, 0.10% or less Zn, 0.20% or less Ti, and the balance substantially Al), or 4047 (which comprises, by weight, 0.30% or less Cu, 11.0–13.0% Si, 0.8% or less Fe, 0.15% of less Mn, 0.10% or less Mg, 0.20% or less Zn, and the balance substantially Al) is used for U-shaped member 4''.

Several examples will be demonstrated below.

EXAMPLE 1

| | |
|---|---|
| Flat tube | ... AA 1050 |
| Fin units | ... AA 1050 |
| U-shaped members | ... AA 4045 |

EXAMPLE 2

| | |
|---|---|
| Flat tube | ... AA 1100* |
| Fin units | ... AA 1050 |
| U-shaped members | ... AA 4045 |

*AA 1100 comprises, by weight, 1.0% or less of total amount of Si and Fe, 0.05–0.20% Cu, 0.05% or less Mn, 0.10% or less Zn, and 99.00% or more Al.

EXAMPLE 3

| | |
|---|---|
| Flat plate | ... AA 3003 |
| Fin units | ... AA 1050 |
| U-shaped members | ... AA 4343 |

In Example 1 or 2, AA 4343 or AA 4047 can be used for foil plates, and in Example 3, AA 4045 or AA 4047 can be used for foil plates.

What is claimed is:

1. In a method for producing an aluminum heat exchanger, wherein a flat aluminum tube is provided having at least one refrigerant passageway therein, said tube being formed into a serpentine-anfractuous shape in a longitudinal direction of said tube and characterized by a plurality of spaced parallel walls, into each space of which a corrugated aluminum metal fin unit is interposed, each brazed to corresponding parallel walls of said flat tube, the improvement which comprises:

providing said serpentine-anfractuous flat aluminum metal tube, said corrugated fin units of a first aluminum metal having a high aluminum content of 99 wt. % or more, and a plurality of U-shaped members of an aluminum alloy filler brazing metal;

closely fitting each of said U-shaped members of brazing metal between and onto said parallel walls of said flat tube, respectively;

closely fitting said corrugated fin units in spaces within said U-shaped brazing members to form a heat exchanger assembly thereof; and heating said assembly to a brazing temperature to effect joining of said fin units and said flat tube and provide a coating layer of said brazing metal on an entire surface of said parallel walls of said flat tube.

2. A method as claimed in claim 1, wherein said flat tube is made of a second aluminum metal having a corrosion potential substantially equal to that of said first aluminum alloy.

3. A method as claimed in claim 1, wherein said flat tube is made of a second aluminum metal having a corrosion potential nobler than that of said first aluminum alloy.

4. A method as claimed in claim 2, wherein said second aluminum metal has a high aluminum content of 99 wt. % or more.

5. A method as claimed in claim 4, wherein said first and second aluminum metals are an aluminum alloy comprising 0.25 wt. % or less Si, 0.40 wt. % or less Fe, 0.05 wt. % or less Cu, 0.05 wt. % or less Mn, 0.05 wt. % or less Mg, 0.05 wt. % or less Zn, 0.03 wt. % or less Ti and 99.50 wt. % or more Al.

6. A method as claimed in claim 3, wherein said second aluminum metal is an aluminum alloy which comprises 0.6 wt. % or less Si, 0.7 wt. % or less Fe, 0.05–0.2 wt. % Cu, 1.0–1.5 wt. % Mn, 0.10 wt. % or less Zn and the balance Al.

7. A method as claimed in claim 1, wherein said U-shaped members are made of an aluminum alloy which comprises 0.3 wt. % or less Cu, 5–13 wt. % Si, 0.8 wt. % or less Fe, 0.15 wt. % or less Mn, up to 0.1 wt. % Mg, 0.2 wt. % or less Zn, and the balance substantially Al.

* * * * *